United States Patent [19]

Haase

[11] Patent Number: 4,904,376

[45] Date of Patent: Feb. 27, 1990

[54] METAL CATCHING COVER

[76] Inventor: Gerald A. Haase, 1005 Country Club Rd., Lake Oswego, Oreg. 97034

[21] Appl. No.: 245,840

[22] Filed: Sep. 16, 1988

[51] Int. Cl.[4] ..... B03C 1/30

[52] U.S. Cl. ..... 209/215; 15/339; 209/228

[58] Field of Search ..... 209/215, 228, 229; 15/105, 339; 294/65.5; 206/818; 211/DIG. 1; 335/303, 306; 7/901

[56] References Cited

U.S. PATENT DOCUMENTS

| | | | |
|---|---|---|---|
| 2,417,762 | 3/1947 | Koller | 7/901 X |
| 2,654,480 | 10/1953 | Stem | 209/215 |
| 2,733,949 | 2/1956 | Russell | 294/65.5 |
| 2,970,002 | 1/1961 | Laviano | 294/65.5 |
| 4,279,745 | 7/1981 | Haase | 209/215 |
| 4,554,703 | 11/1985 | Matuki | 209/215 X |

*Primary Examiner*—Donald T. Hajec
*Attorney, Agent, or Firm*—Olson & Olson

[57] ABSTRACT

A removable cover for my earlier patented magnetic cleaning devices, the cover comprising a plurality of hollow pockets interconnected at their rear, open ends by thin webs which permit longitudinal flexiblity. The interconnected pockets are configured and positioned to receive the projecting magnet pockets of a magnetic cleaning device attached to a vacuum cleaner or a sweeper in a snug, friction fit engagement, thereby securing the cover releasably onto the magnetic cleaning device. When the magnetic cleaning device passes over a floor surface and picks up magnetically attracted objects, the magnetic attraction holds the magnetically attracted objects firmly against the overlying cover. The cover is then simply pulled off of the magnetic cleaning device and the metallic objects, now released from the magnetic attraction of the cleaning device, simply fall away from the cover into a waste receptacle, or alternatively as in this embodiment, into the confines of a forwardly projecting tray provided about the periphery of the cover adjacent its rear, open end. The cover is then ready to be reinstalled onto the magnetic cleaning device for another use.

4 Claims, 1 Drawing Sheet

METAL CATCHING COVER

BACKGROUND OF THE ART

This invention relates to my earlier inventions, Magnet Attachment For Vacuum Cleaners, U.S. Pat. No. 4,279,745; and Magnetic Sweeper, U.S. Pat. No. 4,407,038, and more particularly the invention provides a removable cover therefor.

Specifically, I have found that in use, once my earlier magnet devices have picked up loose magnetically attracted objects from a floor surface, removing the objects for discard is often a somewhat awkward and time consuming inconvenience to a user. This is particularly true with debris captured between individual magnet-containing pockets, for debris can collect on all exposed surface areas of these magnet pockets.

SUMMARY OF THE INVENTION

In its basic concept, this invention provides a non-magnetic, removable cover configured to be releasably secured to the magnet cleaning devices of my earlier invention to overlie and surround each magnet-containing pocket thereof, whereby magnetically attracted debris is allowed to collect on the cover surface only and, upon removing the cover from the magnetic device, the debris simply falls off the cover, which is then ready to be reinstalled back onto the magnet devices for re-use.

It is by virtue of the foregoing basic concept that the principle objective of this invention is achieved; namely, the provision of a removable cover for my magnetic cleaning devices which greatly simplifies and expedites removal of collected magnetically attracted debris for discard, and completely eliminates the need of manual cleaning of the magnet devices themselves.

Another object of this invention is the provision of a magnetic cleaning device cover of the class described which permits the entire surface area of each magnet-containing pocket to remain functional.

Another object of this invention is the provision of a magnetic cleaning device cover of the class described which is trimmable in length to be usable on magnetic cleaning devices having different lengths.

Still another object of this invention is the provision of a magnetic cleaning device cover of the class described which does not reduce the effectiveness of the magnetic cleaning devices.

A further object of this invention is the provision of a magnetic cleaning device cover of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 2:
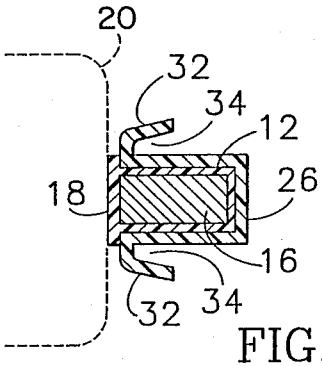
FIG. 2 is a side elevation in section taken along the line 2—2 in FIG. 1.
Figure 1:
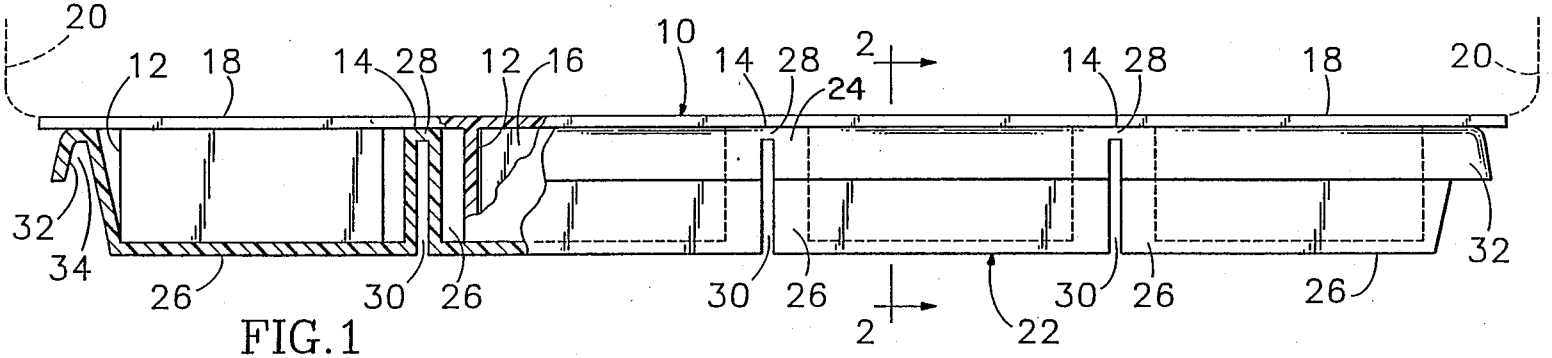
FIG. 1 is a plan view of the cover embodying the features of this invention, the top being broken away in the left-hand portion of the drawing to expose parts otherwise hidden by the overlying cover.

In each of my earlier patented magnetic cleaning devices, there is basically provided a longitudinally flexible housing 10 having a plurality of individual, forwardly projecting pockets 12 spaced apart by thin webs 14, each pocket containing a magnet 16. The housing includes a rear wall 18 configured for mounting to the front lowermost wall 20 of a vacuum cleaner or a sweeper body.

The present invention provides a cover 22 in the form of a longitudinally flexible housing 24 of non-magnetic material, preferably synthetic thermoplastic resin. The housing incorporates a plurality of laterally spaced apart, outwardly projecting hollow pockets 26, open at their rear ends, and connected together longitudinally by thin webs 28 forming open spaces or slots 30 between individual projecting pockets. This construction allows the housing longitudinal flexibility for easy installation and removal as will be described later.

Each pocket 26 is defined by a front end wall, lateral side walls, longitudinal end walls, an open rear end; and is dimensioned and configured to receive a projecting magnet-containing pocket 12 of a magnet device 10 within its hollow confines when the cover is pressed into position engaging and covering the pockets 12 of the magnet device. The internal lateral dimension of each cover pocket 26 preferably closely matches the external lateral dimension of the magnet pockets 12, so that there is formed a snug friction fit between the cover and the magnet attachment 10. This eliminates the need for locks, etc. to secure the cover releasably, but positively in operative position overlying and surrounding the magnet containing pockets 12 of the magnet device.

In the preferred embodiment, the cover is formed of a rigid material, such as mentioned before, synthetic thermoplastic resin, the cover's longitudinal flexibility provided by the thin webs 26 that span individual pockets.

The cover is preferably configured to include an outwardly projecting, peripheral tray 32 that forms an open slot 34 around the cover extending outwardly from the rear wall formed by the open pockets and the interconnecting webs. The tray is provided on at least one of the lateral side walls, adjacent the open rear end of the pocket, and extends forwardly towards the front end wall and is spaced from the lateral side wall, thereby forming a debris-catching space therebetween. The front end wall of the pocket is spaced forwardly of the open rear end and beyond the tray 32. Alternatively, the tray may be provided only on the lateral sides of the housing, if so desired for manufacturing simplicity or length limitation that would make a fully encircling tray construction less desirable. In this manner, the slot thus formed provides a tray to catch magnetically attracted objects falling off of the cover when it is removed from the magnetic cleaning device, as will be described.

The use of the cover described hereinbefore is as follows: The cover 22 is installed simply by placing it over the magnetic cleaning device 10, already installed on a vacuum cleaner, or the like, with the open pockets 26 of the cover aligned with the projecting magnet-containing pockets 12 of the cleaning device. The cover is then simply pressed onto the magnet device and remains in position by virtue of its construction which provides a snug, friction fit between the inner surface of the hollow cover pockets and the outer surface of the pockets of the magnet-containing device.

The vacuum cleaner or sweeper is then used normally, the magnetic cleaning device picking up loose magnetically attracted objects from the floor surface and holding them by magnetic attraction to the surface of the cover.

When it is desired that the objects collected by the magnetic cleaning device be discarded, the vacuum cleaner is preferably laid on the floor with its front end mounting the cleaning device pointed vertically upward. One end of the cover is grasped, and pulled vertically upward, separating it from the magnetic cleaning device. As the cover is removed, the magnetic attraction holding the metallic objects to the cover lessens, and the metallic objects simply fall by gravity vertically downward, where they are captured in the slot 34 formed by the tray 32 encircling the cover. The cover, now completely separated from the magnetic cleaning device, is carried to a waste container and inverted, whereby the loose objects simply fall off. The cover is then ready to be reinstalled onto the magnetic cleaning device for another use.

Alternatively, the vacuum cleaner or sweeper could be held with its front end facing downwardly directly over a waste container or the like, and the cover pulled downwardly off of the magnet device, thereby allowing the metallic objects to simply fall by gravity directly into the waste container.

From the foregoing it will be apparent to those skilled in the art that the present invention provides a very efficient and simplified cover which greatly improves the ease of use of my earlier inventions, and completely eliminates the heretofore necessary and inconvenient step of manually removing metallic objects from my magnetic cleaning apparatus.

It will also be apparent to those skilled in the art that various changes other than those already described may be made in the size, shape, type, number and arrangement of parts described hereinbefore without departing from the spirit of this invention and the scope of the appended claims.

Having thus described my invention and the manner in which it is used, I claim:

1. A removable cleaning cover for magnetic cleaning devices of the type having a magnet-containing means, the cover comprising:

(a) a longitudinally flexible, elongated housing formed of non-magnetic material, (b) the elongated housing incorporating at least one longitudinally elongated, forwardly projecting pocket having a hollow interior, the pocket being defined by a front end wall, lateral side walls, longitudinal end walls, and an open rear end, (c) the pocket extending along the length of the housing and configured to removably receive, within the confines of its hollow interior, the magnet-containing means of the magnetic cleaning device in a friction fit for securing the housing releasably onto the magnetic cleaning device, and (d) a tray means on at least one of said lateral side walls adjacent the open rear end of the pocket and extending forwardly towards said front end wall and being spaced from said one lateral side wall of the pocket thereby forming a debris-catching space therebetween, the front end wall of the pocket being spaced forwardly of the open rear end and beyond the tray means.

2. The cover of claim 1 wherein said tray means encircles the longitudinal end walls and lateral side walls.

3. The cover of claim 1 wherein a plurality of longitudinally interconnected spaced apart pockets are provided along the length of the housing, each configured to align with and receive a corresponding magnet-containing means of the magnetic device having a plurality of spaced apart magnet means.

4. The cover of claim 3 wherein said pockets are spaced apart by thin webs, forming open spaces between longitudinally adjacent pockets.

* * * * *